US006341980B1

(12) United States Patent
Hio et al.

(10) Patent No.: US 6,341,980 B1
(45) **Date of Patent: *Jan. 29, 2002**

(54) TERMINAL HARDWARE FOR FLAT-TYPE CONDUCTOR

(75) Inventors: Masahide Hio; Hajime Okada, both of Yokkaichi (JP)

(73) Assignee: Sumitomo Wiring Systems, Ltd., Yokkaichi (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,886

(22) Filed: Oct. 12, 2000

(30) Foreign Application Priority Data

Oct. 22, 1999 (JP) ..... 11-301327

(51) Int. Cl.[7] ..... H01R 11/20
(52) U.S. Cl. ..... 439/422
(58) Field of Search ..... 439/422, 421

(56) References Cited

U.S. PATENT DOCUMENTS

| | | | | |
|---|---|---|---|---|
| 4,082,402 A | | 4/1978 | Kinkaid et al. | 439/422 |
| 4,832,620 A | | 5/1989 | Yamamoto | 439/422 |
| 4,834,673 A | * | 5/1989 | Beinhaur et al. | 439/422 |
| 6,135,779 A | * | 10/2000 | Kock et al. | 439/422 |

FOREIGN PATENT DOCUMENTS

JP 63-73862 5/1988

* cited by examiner

*Primary Examiner*—Renee Luebke
*Assistant Examiner*—Felix O. Figueroa
(74) *Attorney, Agent, or Firm*—Greenblum & Bernstein, P.L.C.

(57) ABSTRACT

Terminal hardware for a flat-type conductor is provided which can provide a high contact pressure between the terminal hardware and the conductor and a superior holding force against a tension tending to separate the terminal hardware from the conductor. At a terminal end of the flat-type conductor, the conductor is exposed on an upper surface. A base plate is formed to extend from a rear end of the terminal hardware, and a top plate is provided so as to face the base plate and be capable of being opened and closed. Two pairs of crimping portions are provided forwardly and rearwardly on the base plate in a longitudinal direction of the base plate. Further, both the base plate and the top plate have undulating-portions, respectively. A front flat portion is provided on the top plate with an elongated projection extending in a longitudinal direction of the top plate and a rear flat portion is also provided on the top plate with a cut-in projection. When the base plate and the top plate receive the terminal end therebetween, since the elongated projection forcefully presses against and indents the conductor, high contact pressure can be applied and thus a reliable electric connection is provided. Further, since the cut-in projection also forcefully presses against and bites into the conductor, holding power against a tension tending to cause separation.

9 Claims, 8 Drawing Sheets

TERMINAL HARDWARE FOR FLAT-TYPE CONDUCTOR

BACKGROUND OF THE INVENTION

1. Field of Invention

The present invention relates to a terminal hardware used to connect to a terminal of a flat-type conductor.

2. Description of Related Art

A flexible flat cable (FFC) and a flexible printed circuit (FPC) are known as flat-type conductors. For example, a construction of an FFC is described as follows. Plural strips of conductors are aligned in parallel and covered and pressed by insulating sheets from both upper and lower sides. Thus, the FFC is formed to have a flexible ribbon-shape. There are two methods to connect terminal hardware to each of the conductors of the FFC as described above: a method that connects the terminal hardware to the conductor covered by the insulating sheet, and a method that connects the terminal hardware to the conductor exposed on one side by peeling the insulating sheet of the terminal.

The latter method is disclosed in Japanese Utility Model Laid-Open Publication No. Sho.63-73862, for example. As shown in FIG. 11, at the terminal of FFC 1, a predetermined amount of an insulating sheet 2 on the upper side is peeled, and a conductor 3 is exposed on the upper side. A terminal hardware 4 having a base plate 6 extending from a rear side of a connection portion 5 is provided to be connected to another terminal hardware. Further, a top plate 7 is integrally formed with the base plate 6 so as to face the base plate 6 and to be capable of being opened and closed with respect to the base plate 6. Claws 8 are provided at opposite side edges of the open end of the top plate 7.

A portion of the exposed conductor 3 is inserted between the base plate 6 and the top plate 7. The claws 8 pierce the FFC 1 on the lower side and are crimped to opposite side edges of the base plate 6. Thus, the FFC 1 is sandwiched between the base plate 6 and the top plate 7, and the top plate 7 is pressed against the conductor 3 to establish connection.

However, in the above-described method, since the entire surface of the flat-shaped top plate 7 contacts the conductor 3, the contact pressure becomes low. Thus, the reliability of electrical contact is poor.

Further, when a tension is applied in a longitudinal direction of the FFC 1, there is a possibility that the claws 8 separate from the FFC 1 (insulating sheet 2) and the terminal hardware becomes separated from the FFC 1, since the claws 8 are caught by the FFC 1 only at a portion where the claws positioned parallel to the tension pierce the FFC.

When a terminal hardware is connected to the conductor 3, which is exposed at a surface, there is a way to avoid the claws 8 piercing the FFC. In this case, the terminal of FFC is formed to have a comb-shape so that each portion where the conductor 3 is exposed is left as a tooth portion. The claws 8 hold the tooth portions of the comb-shape and are crimped thereto to fix the terminal hardware to the terminal of the FFC. However, the terminal hardware 4 is also easily separated from the terminal particularly in this case.

The present invention is provided to eliminate the above-described drawbacks. An objective of the present invention is to provide a terminal hardware for a flat-type conductor having a high contact pressure between a conductor and the terminal hardware, and a superior holding force against a tension.

SUMMARY OF THE INVENTION

To achieve the above and/or other goals, the present invention provides terminal hardware connected to a terminal end of a flat-type conductor having a conductor exposed on one surface. The terminal hardware includes a pair of plates that face each other and receive the conductor therebetween, and a crimping portion that projects from a side edge of one of the pair of the plates and that is bendable and crimpable to a side edge of the other one of the pair of the plates. An elongated projection is provided on one of the pair of the plates facing the exposed surface of the conductor, and is extended in a longitudinal direction of the pair of plates.

Further, an engaging and retaining portion, which is configured to engage with and retain the terminal end of the flat-type conductor, is provided on at least one of the pair of the plates and is located forwardly from the elongated projection in a direction in which the terminal hardware extends to engage with the flat-type conductor.

According to the features of the present invention, since the elongated projection forcefully presses against and indents the conductor, high contact pressure can be applied and consequently stable electrical connection can be achieved. Further, even when a tension tending to separate the terminal hardware from the flat-type conductor is applied, since an engaging and retaining portion that engages with and retains the conductor is provided, the holding power against the tension can be increased. In addition, the engaging and retaining portion is provided forwardly from the elongated projection in a direction to which the terminal hardware extends to engage with the conductor, the tension applied to the contact portion between the terminal hardware and the terminal end is effectively avoided.

The elongated projection can be located at approximately the same position in the longitudinal direction of the pair of plates as a position of the crimping portion. Thus, since the elongated projection forcefully presses against and indents the conductor more effectively, a higher contact pressure can be achieved. Preferably, the crimping portion is a pair of crimping portions projecting from opposite side edges of one of the pair of plates.

The engaging and retaining portion can be formed to have an undulating-shape. Accordingly, since the terminal hardware contacts the conductor at broader area, the reliability of the electrical contact can be increased.

Further, a piercing portion can be bent at a front end of one of the pair of plates facing the exposed surface of the conductor in a direction to which the terminal hardware extends to engage with the flat-type conductor. The piercing portion pierces the conductor. Accordingly, since the piercing portion pierces the conductor and provides a hook, the holding power against the tension tending to cause separation can be further increased.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

In the following, embodiments of the present invention are described with reference to the figures.

Figure 1:
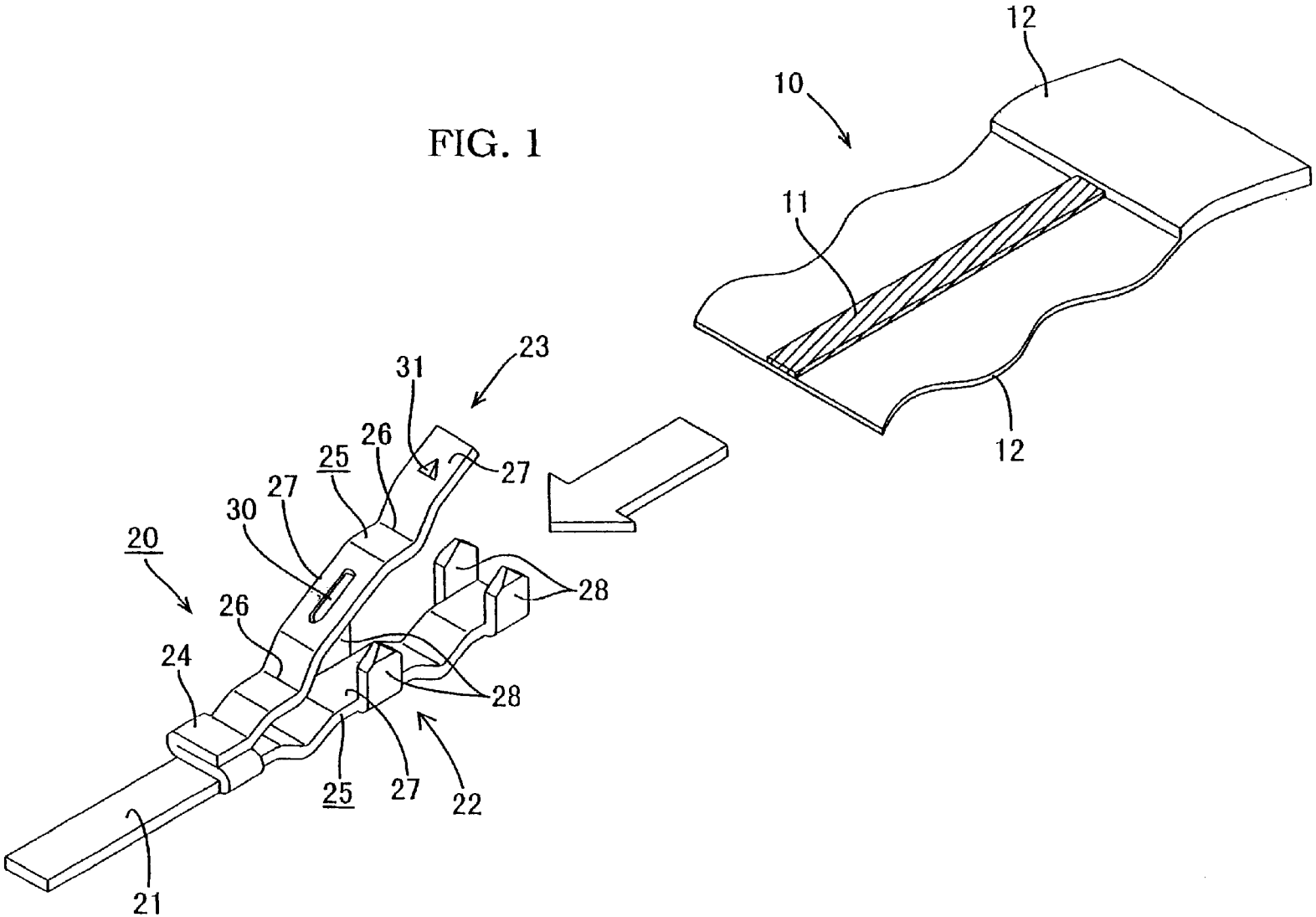
FIG. 1 is a perspective view illustrating an FFC and a terminal hardware before connection, according to a first embodiment of the present invention.

A first embodiment of the present invention is explained with reference to FIGS. 1 through 5. In FIG. 1, a flexible flat cable (FFC) 10 is shown as an example of a flat-type conductor. Plural strips of conductors 11 are aligned in parallel and spaced at predetermined distances. The plural strips of conductors 11 are covered and pressed by insulating sheets 12 from both upper and lower sides. Thus, the FFC is formed to have a flexible ribbon-shape. Predetermined areas of the insulating sheet of an upper side are peeled off at a terminal end of the FFC 10. Thus, conductors 11 are aligned while the upper surfaces are exposed. The insulating sheet may be peeled off on both the upper and lower sides.

Figure 2:
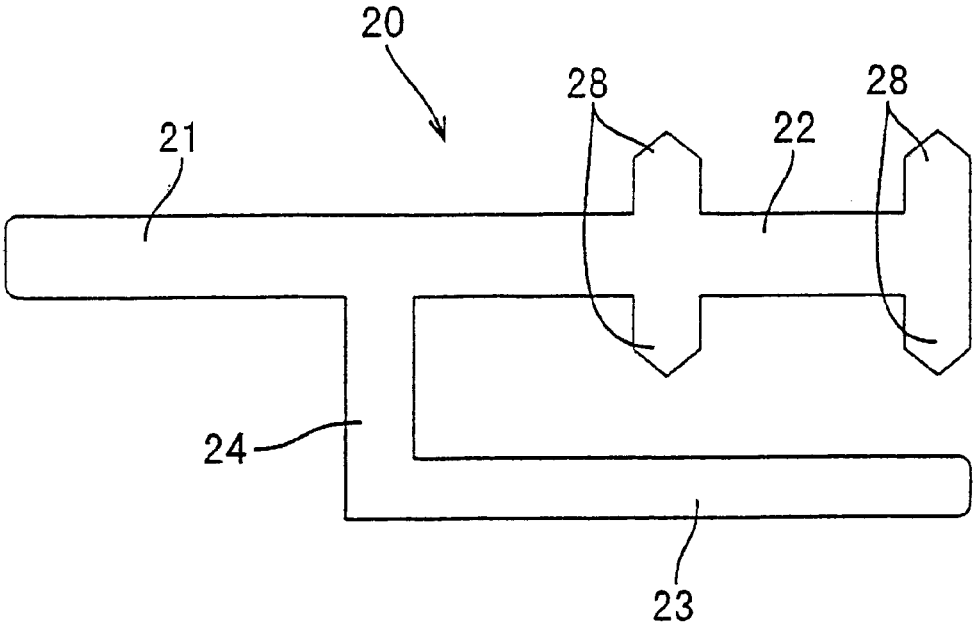
FIG. 2 depicts a blank used to form a terminal hardware according to the first embodiment of the present invention.

The terminal hardware 20 of the present embodiment is a male terminal hardware and is made of a metal plate having superior conductivity by press molding, for example. The terminal hardware 20 includes a tab 21, which is configured to be engaged with a female terminal hardware, and a base plate 22 extending from the rear end of the tab 21. The terminal hardware 20 further includes a top plate 23 facing the base plate 22. A blank for forming the terminal hardware 20 is shown in FIG. 2. The blank has the tab 21 and the base plate 22 formed as a single strip. The top plate 23 is provided parallel to the base plate 22 via a folding portion 24, which projects from a side edge at a proximal end of the tab 21 (i.e. the connection point between the tab 21 and the base plate 22). The pair of crimping portions 26 project from opposite side edges of the base plate 22. The blank may be formed, for example, by punching from the metal plate. When the folding portion 24 is tightly folded twice as shown in FIG. 1, the top plate 23 faces the base plate 22 and can be opened and closed at the rear end (right side in FIG. 1). Then, the base plate 22 and the top plate 23 are formed with complementary undulations, for example, by pressing. Finally, the crimping portions are bent toward the top plate 22 to extend upwardly from the base plate.

A portion of the top plate 23 faces the base plate 22 so as to be able to be opened and closed and is about the same length as the length of the conductor 11 exposed. Further, the width of the base plate 22 and the top plate 23 are set slightly wider than the width of the conductor 11. Each of the base plate 22 and the top plate 23 has an undulating portion 25 including two troughs 26 spaced in the longitudinal direction. The undulating portions 25 of the base plate 22 and the top plate 23 are formed so as to engage with each other. Two pairs of crimping portions 28 respectively project upwardly from opposite side edges of the flat portion 27 at the rear end and from opposite side edges of the flat portion 27 between the two troughs 26 of the base plate 22. The tip of each crimping portion is formed to be sharp.

An elongated projection 30 is formed at approximately the center of the width of the flat portion 27 of the top plate 23 between the two troughs 26 extending in the longitudinal direction, and projects downwardly (to the bottom side) therefrom.

Figure 3:
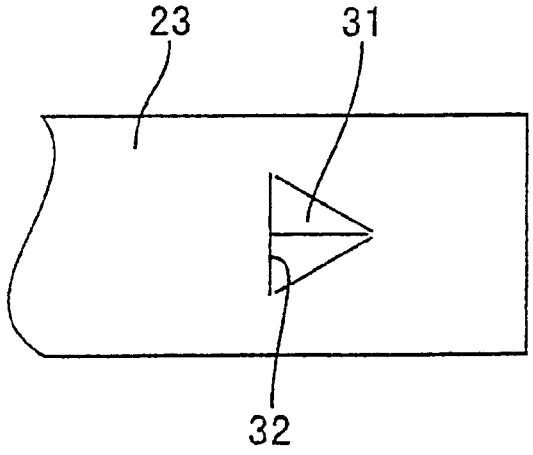
FIG. 3 is a partial top plan view illustrating the shape of a cut-in projection according to the first embodiment.
Figure 4:
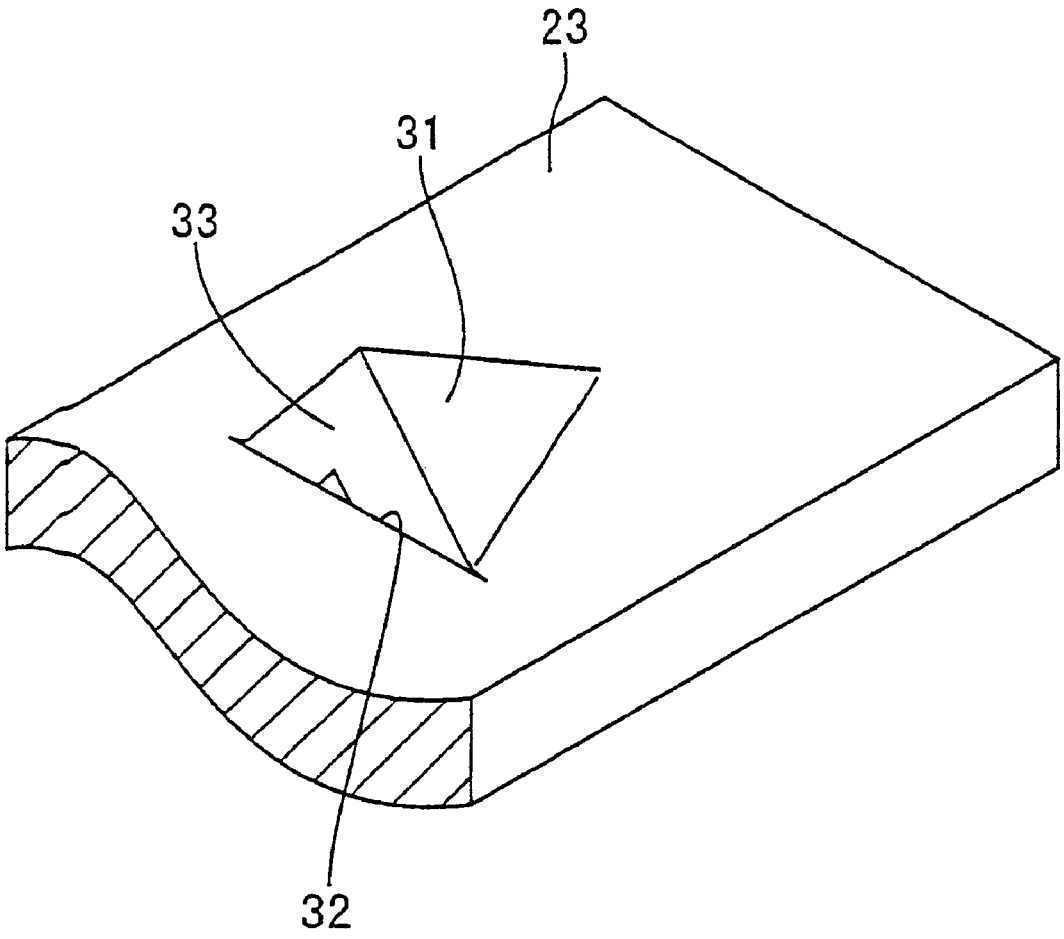
FIG. 4 is a perspective view from a bottom side illustrating the cut-in projection of FIG. 3.
Figure 5:
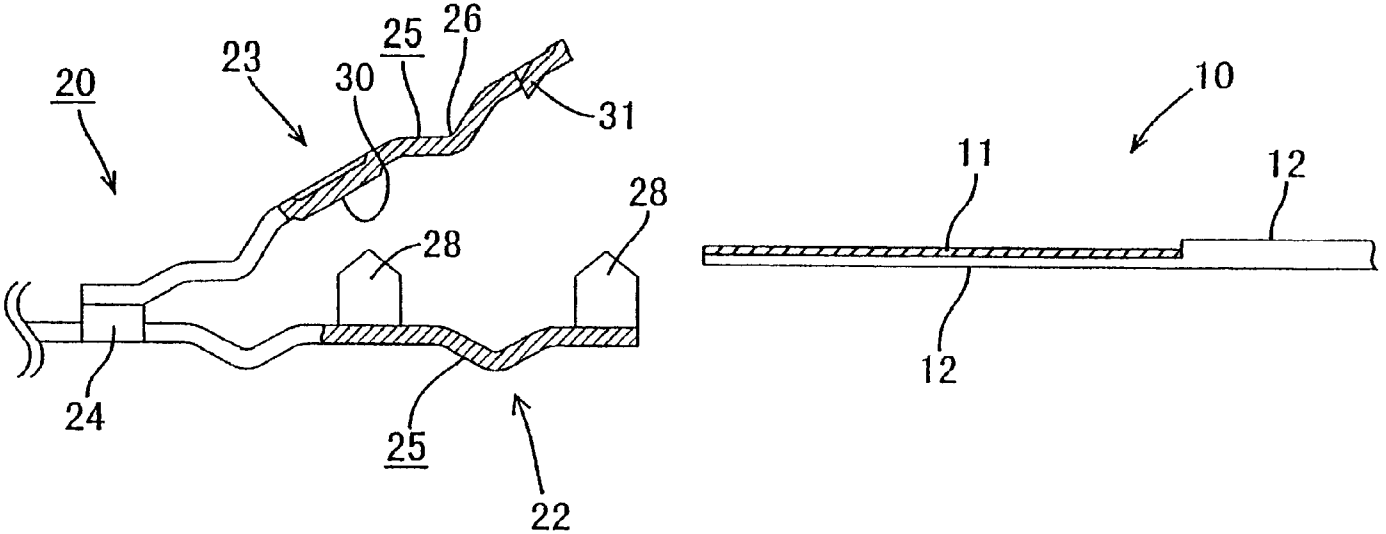
FIG. 5 is a partial cross-sectional view illustrating the FFC and the terminal hardware before connection, according to the first embodiment of the present invention.

Further, a cut-in projection 31 is provided on the flat portion 27 at the rear end. In more detail, as shown in FIG. 3, the cut-in projection 31 forms a triangle having an apex directed rearwardly in the plane of the flat portion 27 of the top plate 23. One side 32 of the triangle, which is perpendicular to the longitudinal direction of the top plate 23, is formed as a cut, and the flat portion 27 of the triangle is embossed to have a wedge-shaped extending toward the bottom side. As shown in FIG. 4, which is a perspective view from the bottom side, a cut end 33, which is shaped as a downward triangle, projects in a direction perpendicular to the longitudinal direction of the top plate 23. In this embodiment, the portions of the base plate 22 and the top plate 23, in front of the elongated projection 30 in a longitudinal direction of the top and base plates in which the terminal hardware extends to engage with the conductor 11, constitute an engaging and retaining portion. Thus, the engaging and retaining portion includes the front trough 26 in the undulating portion 25, the front pair of crimping portions 28 and the cut-in projection 31.

In the following, a connection process of the first embodiment is explained.

Figure 6:
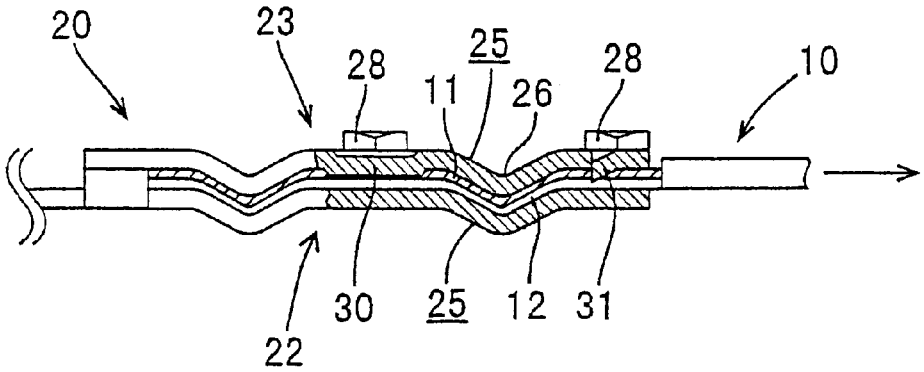
FIG. 6 is a partial cross-sectional view illustrating the FFC and the terminal hardware after connection, according to the first embodiment of the present invention.
Figure 7:
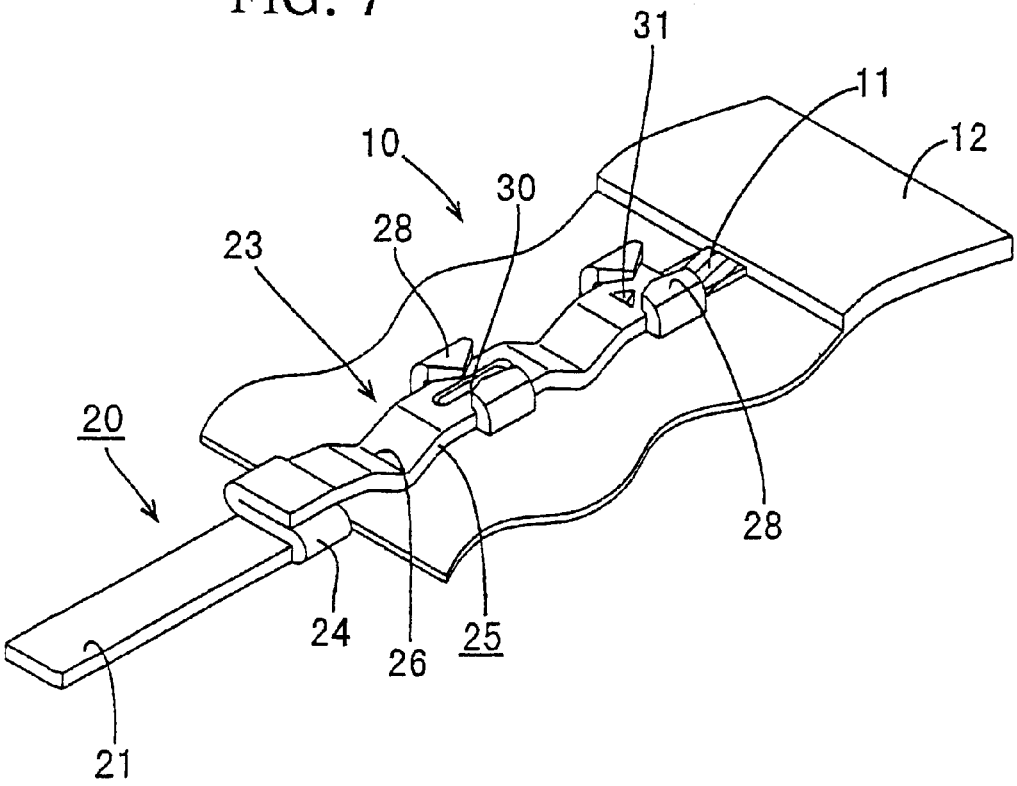
FIG. 7 is a perspective view illustrating the FFC and the terminal hardware after connection, according to the first embodiment of the present invention.

As shown in FIGS. 1 through 5, the top plate 23 of the terminal hardware is opened upwardly. Under this condition, the FFC 10 is inserted between the base plate 22 and the top plate 23, while the terminal hardware 20 is aligned with the conductor 11. Next, the two pairs of the crimping portions 28 provided on the base plate 22 pierce the insulating sheet 12 toward the upper surface. Then, the terminal on the FFC 10 is sandwiched between the base plate 22 and the top plate 23 and is pressed. Then, each of the two pairs of the crimping portions 26 is bent inwardly and is crimped to opposite side edges of the top plate 23. Accordingly, as shown in FIGS. 6 and 7, the base plate 22 and the top plate 23 hold the conductor 11 therebetween and are closed together to be connected with each other.

Since the conductor 11 is sandwiched between and pressed by the base plate 22 and the top plate 23, the conductor 11 is bent in an undulating-shape having the same shape as the undulating portions 25. At the same time, the elongated projection 30 provided on the top plate 23 forcefully presses against and indents the conductor 11, and further the cut-in projection 31 forcefully presses against and bites into the conductor 11.

In other words, since the elongated projection 30 contacts the conductor 11 so as to indent the conductor 11, high contact pressure can be applied and consequently a stable electrical connection can be achieved.

Further, the FFC 10 as described above is used in such a way that the terminal hardware 20 connected to the terminal is stored in a cavity of a connector housing (not shown). In this case, a tension toward the rear end (direction of the arrow in FIG. 6) may be applied to the FFC 10. However, according to the present embodiment, since the cut-in projection 31 forcefully presses against and bites into the conductor 11, a hook can be provided against a direction of a tension tending to separate the terminal hardware from the terminal. In addition, the cut end 33, which is perpendicular to the longitudinal direction of the top plate 23, is provided in the front side of the cut-in projection 31. The cut end 33 forcefully presses against and bites into the conductor 11. Accordingly, the holding power of the FFC 10 against the tension further increases. Thus, the terminal hardware 20 is prevented from easily separating from the terminal of the FFC 10.

Moreover, in the present embodiment, the base plate 22 and the top plate 23 bend the terminal of the FFC 10 in the undulating-shape and engage therewith. In particular, the troughs 26 of the undulating portions 25 can provide a hook. Accordingly, this construction also securely provides the holding power against the tension tending to cause separation. Further, the undulating portion 25 is also effective to provide an efficient amount of contact area between the top plate 23 and the conductor 11.

Figure 8:
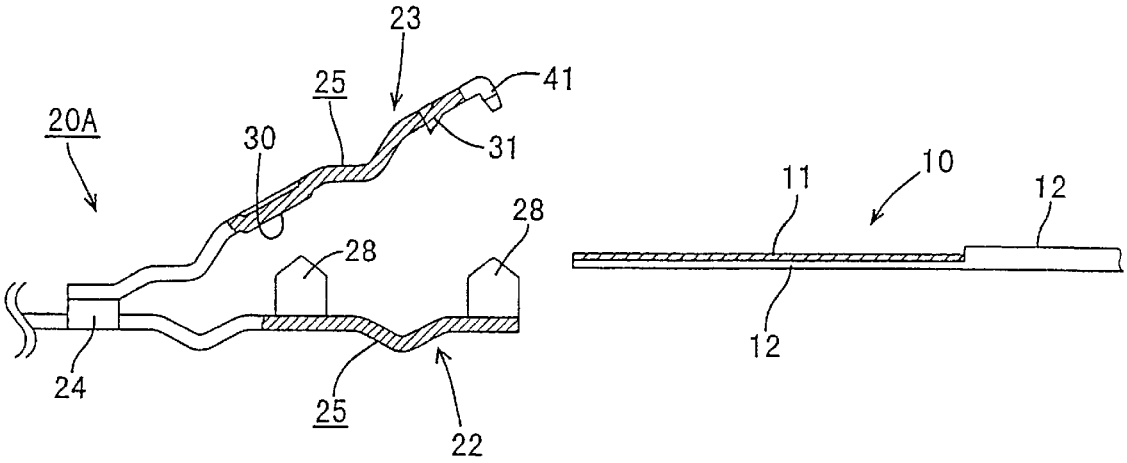
FIG. 8 is a partial cross-sectional view illustrating the FFC and the terminal hardware before connection, according to a second embodiment of the present invention.

Next, the second embodiment of the present invention is explained with reference to FIGS. 8 and 9. The terminal hardware 20A of the second embodiment has a piercing portion 41, capable of piercing the FFC 10, at the rear end of the top plate 23. The piercing portion 41 has a sharp tip and is bent at a right angle toward the base plate 22 side. The other constructions are similar to those of the first embodiment. Therefore, the same reference numerals as in the first embodiment are given to portions having the same functions as that of the first embodiment, and a repetition of the explanation thereof is omitted. Similarly to the first embodiment, the front undulating portions 25, the front crimping portions 28 and the cut-in projection 31 constitute an engaging and retaining portion.

Figure 9:
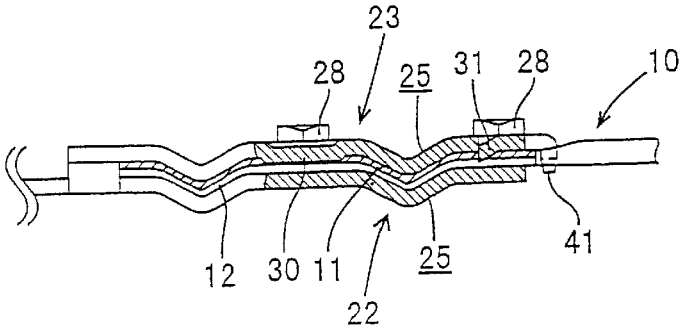
FIG. 9 is a partial cross-sectional view illustrating the FFC and the terminal hardware after connection, according to the second embodiment of the present invention.

According to the second embodiment, as shown in FIG. 9, when the base plate 22 and the top plate 23 receive the terminal of FFC 10 therebetween and are compressed, the piercing portion 41 provided at the rear end of the top plate 23 pierces a portion of the FFC 10 where both the upper and the lower surfaces of the FFC 10 are covered by insulating sheets 12 toward the lower surface side.

In other words, since the piercing portion 41, which has a width in the direction perpendicular to the tension tending to separate the terminal hardware from the FFC 10, pierce the FFC 10, the holding power against the tension to the FFC 10 can be increased.

Figure 10:
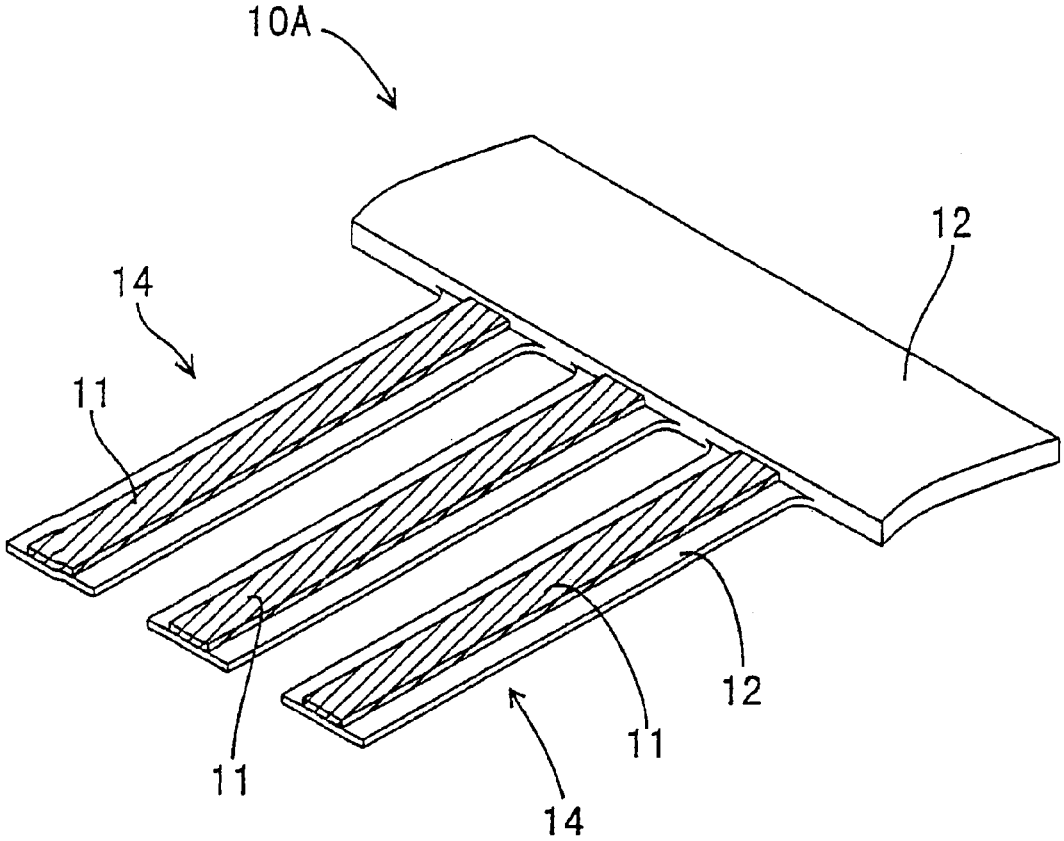
FIG. 10 is a perspective view illustrating the FFC before the connection to the terminal hardware, according to a third embodiment of the present invention.
Figure 11:
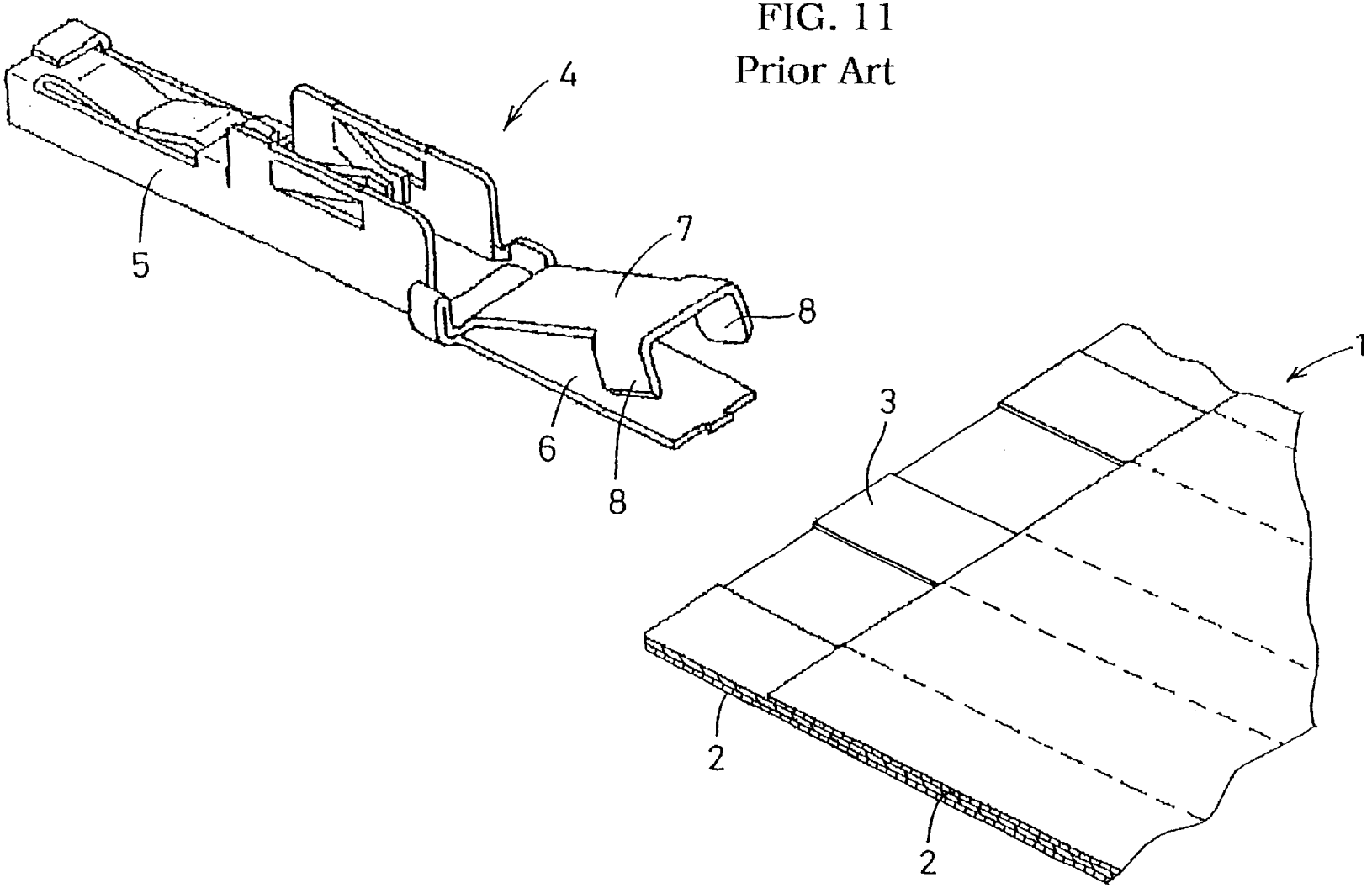
FIG. 11 Prior Art
FIG. 11 is a perspective view illustrating a conventional terminal hardware and a FFC.

FIG. 10 shows a third embodiment of the present invention. In the third embodiment, the shape of the terminal end of the FFC 10A is changed. Here, the terminal end of the FFC 10A is formed in a comb-shape by leaving only portions of insulation where the conductors 11 are provided.

When the terminal hardware 20 of the first embodiment is connected to the FFC 10A, the crimping portions 28 provided on the base plate 22 hold the comb-tooth portion 14 and are crimped to the opposite side edges of the top plate 23 to be fixed with each other. In this case, since the crimping portion 28 is not required to pierce the insulating sheet 12, the connecting operation of the terminal hardware becomes easier. Further, a possibility of damage to the FFC 10A can be reduced.

Since the base plate 22 and the top plate 23 bend the comb-tooth portion 14 in an undulating-shape and engage therewith, and the cut-in projection 31 forcefully presses against and bites into the conductor 11, the holding power against the tension tending to separate the terminal from the terminal can be increased.

The terminal hardware 20A of the second embodiment can also be connected to the comb-tooth portion 14 of the FFC 10A.

It is noted that the present invention is not limited by the embodiments explained above using the description and drawings, but the following embodiments; for example, can also be included in the scope of the present invention. Further, in addition to the following, the present invention can be embodied with a variety of changes in so far as it does not depart from the subject of the present invention.

(1) The embodiments described above have a top plate provided unitarily and in one piece with the base plate, and has an advantage that the handling of the terminal hardware is convenient and easier. However, it is possible to provide the top plate separately from the base plate.

(2) The terminal hardware can be connected with the terminal so that the top plate and the base plate are reversed. In this case, since the base plate contacts the conductor, the elongated projection and the cut-in projection are provided on the base plate.

(3) In the first embodiment, the cut-in projection and the undulating portion are provided as engaging and retaining portions to prevent the terminal hardware from separating from the terminal. However, it is possible to provide either one of the cut-in projection and the undulating portion. Alternatively, it is also possible to provide a crimping portion to crimp the terminal hardware to the FFC as an engaging and retaining portion.

(4) The piercing portion shown in the second embodiment can be provided at the rear end of the base plate.

(5) In the embodiments described above, the widths of the base plate and the top plate are wider than the width of the conductor. However, the widths of the base plate and the top plate can be thinner than the conductor so that the crimping portions pierce the conductor.

(6) In the embodiments described above, the tips of the crimping portions have sharp points to pierce the FFC easily. However, when the crimping portion holds the comb-tooth portion as shown in the fourth embodiment, the sharp points are not required.

(7) The crimping portions can be provided on the top plate instead of the base plate. Further, the crimping portion can be provided only at one side edge of the top or bottom plate, instead of a pair of them provided on opposite side edges.

(8) A female-type terminal hardware can be provided according to the present invention as well as the male-type terminal hardware.

(9) The terminal hardware of the present invention can be used with a flat-type conductor, such as a FPC (flexible printed circuit), which has a conductor covered by insulating layers, formed in a flat-shape and exposed at a terminal, as well as the FFC explained in the embodiment described above, as an example.

It is noted that the foregoing examples have been provided merely for the purpose of explanation and are in no way to be construed as limiting of the present invention. While the present invention has been described with reference to certain embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

The present disclosure relates to subject matter contained in priority Japanese Application No. HEI 11-301327, filed on Oct. 22, 1999, which is herein expressly incorporated by reference in its entirety.

What is claimed is:

1. A terminal hardware connectable to a terminal end of a flat-type conductor having a conductor exposed on one surface, said terminal hardware comprising:

a pair of plates that face each other to receive the conductor therebetween, each of the pair of plates respectively having opposing undulating portions configured to engage with each other when there is no conductor between the pair of plates, each undulating portion including two troughs spaced in a longitudinal direction of said pair of plates;

a crimping portion that projects from a side edge of one of said pair of plates and that is bendable and crimpable to a side edge of the other one of said pair of plates; and an elongated projection provided on one of said pair of plates facing the exposed surface of the conductor to contact the conductor, said elongated projection extending in the longitudinal direction of said pair of plates.

2. The terminal hardware according to claim 1, further comprising a cut-in projection provided forwardly of the elongated projection in a direction in which the terminal hardware extends to engage with and retain the flat-type conductor.

3. The terminal hardware according to claim 2, wherein the elongated projection and the cut-in projection are provided on a same one of said pair of plates.

4. The terminal hardware according to claim 1, further comprising a second crimping portion provided at a side edge at a front end of one of said pair of plates in the direction in which the terminal hardware extend to engage with and retain the flat-type conductor.

5. The terminal hardware according to claim 4, further comprising a cut-in projection provided forwardly of said elongated projection in a direction in which said terminal hardware extends to engage with and retain the flat-type conductor, wherein said cut-in projection is located so that at least a portion of said cut-in projection overlaps said second crimping portion in the longitudinal direction of said pair of plates.

6. The terminal hardware according to claim 1, wherein said undulating portion includes at least two troughs spaced in the longitudinal direction of said pair of plates and said elongated projection is located so that at least a portion of said elongated projection overlaps said crimping portion in the longitudinal direction of said pair of plates.

7. The terminal hardware according to claim 1, wherein the crimping portion comprises a pair of crimping portions projecting from opposite side edges of one of said pair of plates and that are bendable and crimpable to opposite side edges of the other one of said pair of plates, and wherein said elongated projection is located so that at least a portion of said elongated projection overlaps said pair of crimping portions in the longitudinal direction of said pair of plates.

8. The terminal hardware according to claim 1, further comprising a piercing portion bent at a front end of one of said pair of plates in a direction in which the terminal hardware extends to engage with and retain the flat-type conductor, the piercing portion configured to pierce the conductor at a front end of another one of said pair of plates without piercing another one of said pair of plates.

9. A terminal hardware connectable to a terminal end of a flat-type conductor having a conductor exposed on one surface, said terminal hardware comprising:

a pair of plates that face each other to receive the conductor therebetween, each of the pair of plates respectively having opposing undulating portions so as to engage with each other when there is no conductor between the pair of plates, each undulating portion including two troughs spaced in a longitudinal direction of said pair of plates;

an elongated projection provided on one of said pair of plates facing the exposed surface of the conductor to contact the conductor, said elongated projection extending in the longitudinal direction of said pair of plates, said elongated projection being provided between said two troughs in the longitudinal direction of the pair of plates;

a cut-in projection provided on one of said pair of plates on which said elongated projection provided, said cut-in projection being provided forwardly of said elongated projection and forwardly of said two troughs in a direction in which the terminal hardware extends to engage with and retain the flat-type conductor;

a first pair of crimping portions that projects from opposite side edges of one of said pair of plates and that are bendable and crimpable to opposite side edges of the other one of said pair of plates, the first pair of crimping portions being located at a same position as said elongated projection in the longitudinal direction of the pair of plates;

a second pair of crimping portions that projects from opposite side edges of one of said pair of plates and that are bendable and crimpable to opposite side edges of the other one of said pair of plates, the second pair of crimping portions being located at a same position as said cut-in projection in the longitudinal direction of the pair of plates; and a piercing portion bent at a front end of one of said pair of plates in the direction in which said terminal hardware extends to engage with and retain the flat-type conductor, said piercing portion being configured to pierce the conductor at a front end of another one of said pair of plates without piercing another one of said pair of plates.

* * * * *